US009146496B2

(12) United States Patent
Yonemoto

(10) Patent No.: US 9,146,496 B2
(45) Date of Patent: Sep. 29, 2015

(54) CLEANING DEVICE, INTERMEDIATE TRANSFER UNIT AND IMAGE FORMING APPARATUS

(71) Applicant: KYOCERA Document Solutions Inc., Osaka-shi, Osaka (JP)

(72) Inventor: Satoru Yonemoto, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/091,220

(22) Filed: Nov. 26, 2013

(65) Prior Publication Data

US 2014/0153956 A1 Jun. 5, 2014

(30) Foreign Application Priority Data

Nov. 30, 2012 (JP) ..... 2012-262259

(51) Int. Cl.
*G03G 15/08* (2006.01)
*G03G 15/16* (2006.01)
*G03G 21/00* (2006.01)

(52) U.S. Cl.
CPC ..... *G03G 15/0817* (2013.01); *G03G 15/161* (2013.01); *G03G 21/0058* (2013.01)

(58) Field of Classification Search
CPC ..... G03G 2221/0015; G03G 15/0817
USPC ..... 399/101, 359, 369
See application file for complete search history.

(56) References Cited

U.S. PATENT DOCUMENTS

| | | | | |
|---|---|---|---|---|
| 7,962,060 | B2 * | 6/2011 | Moon | 399/102 |
| 2005/0180774 | A1 * | 8/2005 | Ohgoshi et al. | 399/103 |
| 2007/0217813 | A1 * | 9/2007 | Miyamoto et al. | 399/101 |
| 2011/0097123 | A1 * | 4/2011 | Eiki | 399/349 |

FOREIGN PATENT DOCUMENTS

JP 2001042735 A 2/2001

* cited by examiner

*Primary Examiner* — Clayton E Laballe
*Assistant Examiner* — Noam Reisner
(74) *Attorney, Agent, or Firm* — Alleman Hall McCoy Russell & Tuttle LLP

(57) ABSTRACT

A cleaning device has housing, cleaning member, pair of bearing portions, toner receiving seal, and end seal. The housing is formed with opening facing, and waste toner retaining portion. The cleaning member is rotatably borne by the pair of bearing portions at both ends of rotation axis. The toner receiving seal is disposed facing to entire area in the longitudinal direction of the cleaning member, and extends to be laid across each end portion of the cleaning member and outer periphery of the bearing portion. The bearing portion has the same outer diameter in contact portion where the toner receiving seal contacts, as outer diameter of the cleaning member. The end seal is disposed, in gap between the housing and each of the bearing portions, facing to the contact portion with the toner receiving seal interposed therebetween, and prevents leakage of waste toner from both end portions of the housing.

4 Claims, 8 Drawing Sheets

CLEANING DEVICE, INTERMEDIATE TRANSFER UNIT AND IMAGE FORMING APPARATUS

INCORPORATION BY REFERENCE

This application is based upon and claims the benefit of priority from the corresponding Japanese Patent Application No. 2012-262259 filed on Nov. 30, 2012, the entire contents of which are incorporated herein by reference.

BACKGROUND

The present disclosure relates to a cleaning device having a mechanism of removing residual toner on an image carrier surface by means of a cleaning member.

In image forming apparatuses based on an electro-photographic system such as a copying machine, a printer and a facsimile machine, a developing agent in the form of powder is typically used, and an electrostatic latent image formed on an image carrier such as a photosensitive drum is visualized by using a developing device. Then the visualized image (toner image) is transferred onto a recording medium and subjected to a fixing treatment. The toner remaining on the image carrier surface is removed by a cleaning device, and a new toner image is formed.

The cleaning device has a cleaning member like a fur brush and a cleaning roller for removing toner from the image carrier surface, a recovery roller for recovering toner from the cleaning member, a conveyance spiral for discharging the toner scraped from the recovery roller surface, a toner receiving seal for partitioning the interior of a housing into a recovery roller side and a conveyance spiral side, and an end seal provided between the toner receiving seal and the housing.

Here, the toner receiving seal guides the toner scraped from the recovery roller surface by a scraper, to the conveyance spiral side to prevent it from going toward the recovery roller side (outer side of the housing). Therefore, the toner receiving seal is required to be in contact with the entire area in an axial direction of the recovery roller at a substantially constant contact pressure that will not scrape off the toner adhering to the recovery roller. On the other hand, the end seal is required to be in contact with the toner receiving seal at a considerable pressure for securely preventing leakage of toner from inside the housing.

However, at an elevated contact pressure of the end seal, the toner receiving seal receives pressure at both end portions from the end seal and the toner receiving seal deforms, so that the contact pressure of the toner receiving seal against the recovery roller also varies. As a result, there exists the problem that the toner adhering to the recovery roller is scraped off by the toner receiving seal, and leaks outside through the opening of the housing.

In this respect, a method for alleviating the pressing force exerted on the end portions of the toner receiving seal from the end seal is proposed. One known exemplary configuration includes a sheet-like guide member (toner receiving seal) that guides the toner removed by the cleaning portion to a cleaner case, and a sealing member for sealing both end faces of the cleaner case, wherein only a tip end portion of the sheet-like guide member is overlapped with the sealing member by providing the sheet-like guide member with a notch portion or by providing the sealing member with a notch portion or a step portion.

SUMMARY

A cleaning device according to one aspect of the present disclosure includes a housing, a cleaning member, a pair of bearing portions, a toner receiving seal, and an end seal. The housing is formed with an opening facing to an image carrier, and a waste toner retaining portion for retaining toner scraped from a surface of the image carrier. The cleaning member is a roller-shaped member disposed near the opening of the housing, for removing residual toner on the surface of the image carrier. The pair of bearing portions rotatably bear both ends of a rotation axis of the cleaning member. The toner receiving seal is disposed facing to the entire area in the longitudinal direction of the cleaning member, and prevents reverse flow of waste toner toward the opening from the waste toner retaining portion. The end seal is disposed in a gap between the housing and each of the bearing portions, and prevents leakage of waste toner from both end portions of the housing. The toner receiving seal extends to be laid across each end portion of the cleaning member and outer periphery of the bearing portion. The bearing portion has the same outer diameter in a contact portion where the toner receiving seal contacts, as an outer diameter of the cleaning member. The end seal is disposed facing to the contact portion with the toner receiving seal interposed therebetween.

An intermediate transfer unit according to another aspect of the present disclosure includes a cleaning device and an intermediate transfer belt. Residual toner on the intermediate transfer belt is removed by the cleaning device. The cleaning device has a housing, a cleaning member, a pair of bearing portions, a toner receiving seal and an end seal. The housing is formed with an opening facing to the intermediate transfer belt, and a waste toner retaining portion for retaining toner scraped from a surface of the intermediate transfer belt. The cleaning member is a roller-shaped cleaning member disposed near the opening of the housing, for removing residual toner on the surface of the intermediate transfer belt. The pair of bearing portions rotatably bear both ends of a rotation axis of the cleaning member. The toner receiving seal is disposed facing to the entire area in the longitudinal direction of the cleaning member, and prevents reverse flow of waste toner toward the opening from the waste toner retaining portion. The end seal is disposed in a gap between the housing and each of the bearing portions, and prevents leakage of waste toner from both end portions of the housing. The cleaning member includes a fur brush for scraping off residual toner on the surface of the intermediate transfer belt, and a recovery roller for recovering waste toner adhering to a surface of the fur brush. The toner receiving seal is disposed facing to the entire area in the longitudinal direction of the recovery roller and extends to be laid across each end portion of the cleaning member and outer periphery of the bearing portion. The bearing portion has the same outer diameter in a contact portion where the toner receiving seal contacts, as an outer diameter of the cleaning member. The end seal is disposed facing to the contact portion with the toner receiving seal interposed therebetween.

An image forming apparatus according to still another aspect of the present disclosure includes a cleaning device. The cleaning device has a housing, a cleaning member, a pair of bearing portions, a toner receiving seal, and an end seal. The housing is formed with an opening facing to an image carrier, and a waste toner retaining portion for retaining toner scraped from a surface of the image carrier. The cleaning member is a roller-shaped cleaning member disposed near the opening of the housing, for removing residual toner on the surface of the image carrier. The pair of bearing portions rotatably bear both ends of a rotation axis of the cleaning member. The toner receiving seal is disposed facing to the entire area in the longitudinal direction of the cleaning member, and prevents reverse flow of waste toner toward the opening from the waste toner retaining portion. The end seal is disposed in a gap between the housing and each of the bearing portions, and prevents leakage of waste toner from both end portions of the housing. The toner receiving seal extends to be laid across each end portion of the cleaning member and outer periphery of the bearing portion. The bearing portion has the same outer diameter in a contact portion where the toner receiving seal contacts, as an outer diameter of the cleaning member. The end seal is disposed facing to the contact portion with the toner receiving seal interposed therebetween.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
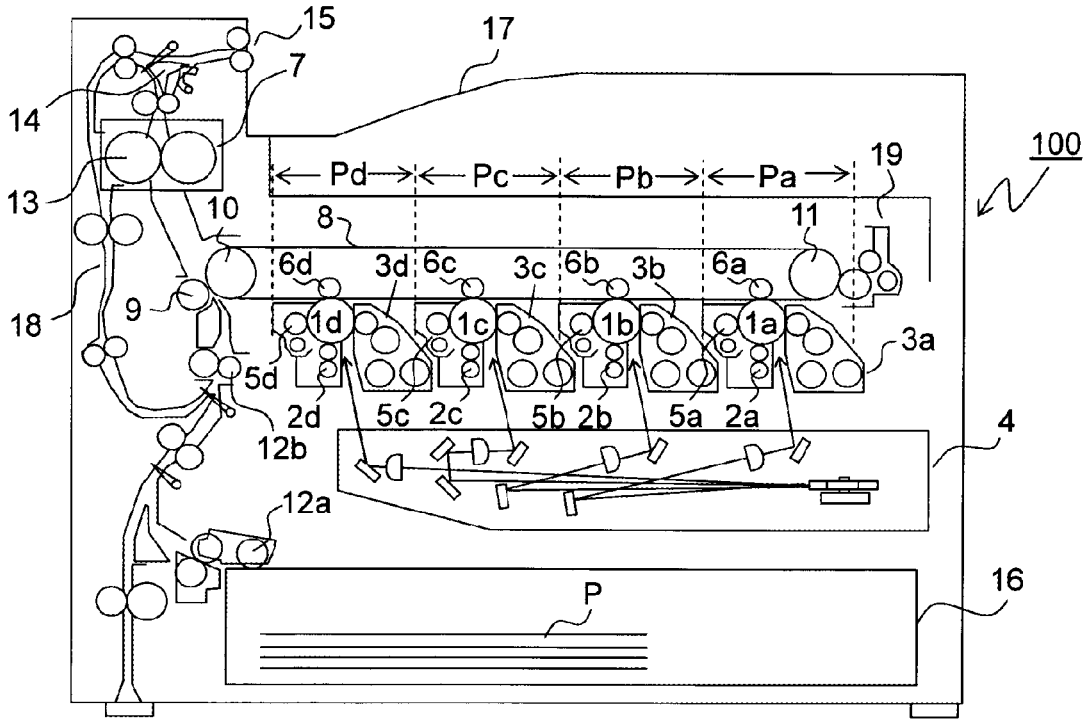
FIG. 1 is a schematic view showing an internal configuration of an image forming apparatus having a cleaning device according to one embodiment of the present disclosure.
Figure 2:
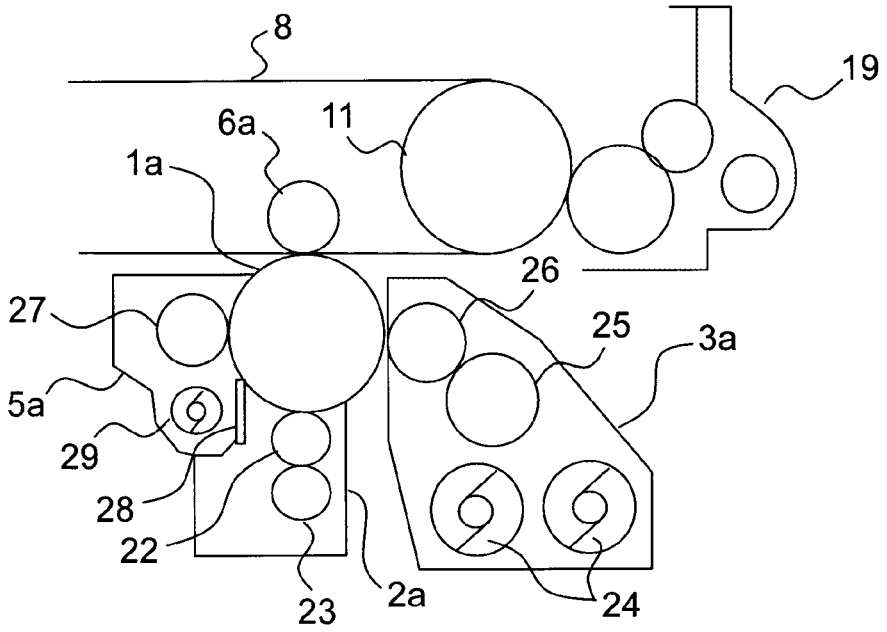
FIG. 2 is an enlarged view of the image forming portion and its vicinity in FIG. 1.
Figure 3:
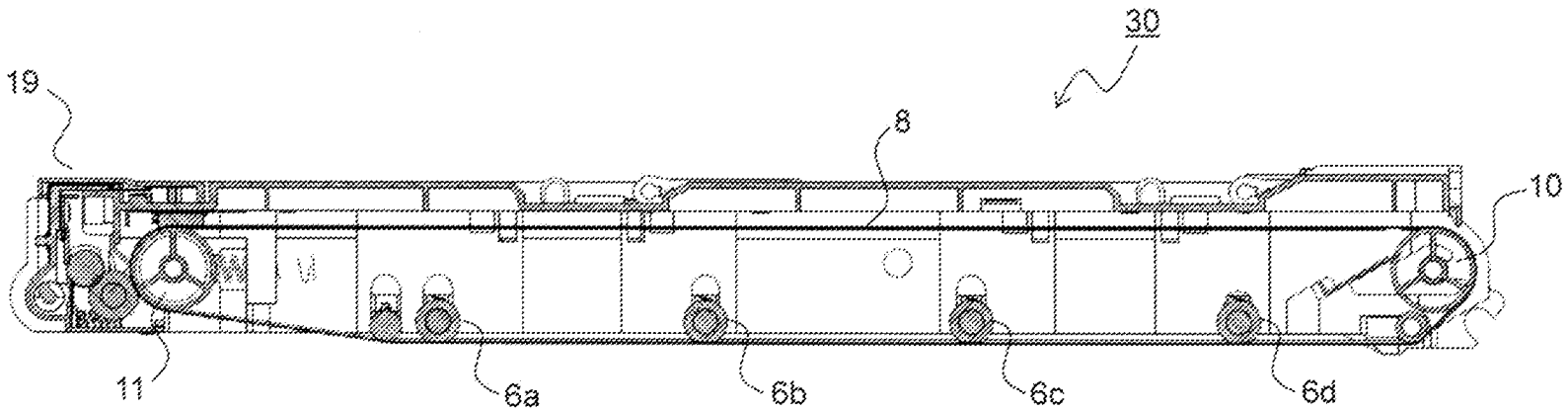
FIG. 3 is a lateral section view of an intermediate transfer unit installed in the image forming apparatus shown in FIG. 1.

Hereinafter, embodiments of the present disclosure will be described in detail based on the drawings. FIG. 1 is a schematic view showing a configuration of an image forming apparatus 100 having a belt cleaning unit 19 embodying a cleaning device of the present disclosure, FIG. 2 is an enlarged view of an image forming portion Pa and its vicinity in FIG. 1, and FIG. 3 is a lateral section view of an intermediate transfer unit 30 installed in the image forming apparatus 100. FIG. 3 shows the intermediate transfer unit 30 in the state seen from the backside of FIG. 1.

The image forming apparatus 100 in FIG. 1 is configured as follows. Inside the image forming apparatus 100 main body, four image forming portions Pa, Pb, Pc and Pd are arranged in this order from the upstream side (right hand in FIG. 1) of the conveyance direction. The image forming portions Pa to Pd are provided in correspondence with images of different four colors (cyan, magenta, yellow and black), and images of cyan, magenta, yellow and black are sequentially formed through the steps of charging, exposure, developing, and transfer.

These image forming portions Pa to Pd are provided with photosensitive drums 1*a*, 1*b*, 1*c* and 1*d* that carry visualized images (toner images) of respective colors. Also, the image forming portions Pa to Pd are provided with an intermediate transfer belt 8 that rotates clockwise in FIG. 1 by a driving portion (not shown) adjacently to each of the image forming portions Pa to Pd. Toner images formed on these photosensitive drums 1*a* to 1*d* are sequentially transferred onto the intermediate transfer belt 8 that moves in abutment with each of the photosensitive drums 1*a* to 1*d*, and then transferred at once onto a transfer paper sheet P which is one example of a recording medium in a secondary transfer roller 9. Then, the toner images are fixed on the transfer paper sheet P in a fixing portion 7, and the transfer paper sheet P is discharged from the image forming apparatus 100 main body. At this time, the image forming process for each of the photosensitive drums 1*a* to 1*d* is executed while each of the photosensitive drums 1*a* to 1*d* is rotated counterclockwise in FIG. 1.

The transfer paper sheet P on which toner images are to be transferred is stored in a sheet cassette 16 situated in a lower part of the image forming apparatus 100 main body. The transfer paper sheet P is conveyed to the secondary transfer roller 9 via a sheet feed roller 12*a* and a registration roller pair 12*b*. As the intermediate transfer belt 8, a sheet of dielectric resin is used. As the intermediate transfer belt 8, a seamless belt is typically used.

Next, the image forming portions Pa to Pd will be described. Around and below the photosensitive drums 1*a* to 1*d* that are rotatably disposed, chargers 2*a*, 2*b*, 2*c* and 2*d* for charging the photosensitive drums 1*a* to 1*d*, an exposure unit 4 for light-exposing image information on each of the photosensitive drums 1*a* to 1*d*, developing units 3*a*, 3*b*, 3*c* and 3*d* for forming toner images on the photosensitive drums 1*a* to 1*d*, and cleaning devices 5*a*, 5*b*, 5*c* and 5*d* for removing a developing agent (toner) remaining on the photosensitive drums 1*a* to 1*d* are provided.

In the following, the image forming portion Pa will be described in detail by referring to FIG. 2, and description for the image forming portions Pb to Pd will be omitted because they have basically the same configuration as the image forming portion Pa. As shown in FIG. 2, around the photosensitive drum 1*a*, the charger 2*a*, the developing unit 3*a*, and the cleaning device 5*a* are arranged along the drum rotation direction (counterclockwise direction in FIG. 1), and a primary transfer roller 6*a* is disposed with the intermediate transfer belt 8 interposed therebetween. On the upstream side of the rotation direction of the intermediate transfer belt 8 with respect to the photosensitive drum 1*a*, a belt cleaning unit 19 is disposed facing to a tension roller 11 with the intermediate transfer belt 8 interposed therebetween.

The charger 2*a* has a charging roller 22 that contacts the photosensitive drum 1*a* and applies a charging bias on the drum surface, and a charge cleaning roller 23 for cleaning the charging roller 22. The developing unit 3*a* has two stirring conveyance screws 24, a magnetic roller 25, and a developing roller 26, and makes toner fly onto the drum surface by applying a developing bias of the same polarity as the toner to the developing roller 26.

The cleaning device 5*a* has a rubbing roller 27, a cleaning blade 28, and a recovery screw 29. The rubbing roller 27 is brought into pressure contact with the photosensitive drum 1*a* at a predetermined pressure, and is rotated in the same direction on the abutment surface with the photosensitive drum 1*a* by a drive portion that is not depicted. Its circumferential velocity is controlled to be higher (in this embodiment, 1.2 times) than that of the photosensitive drum 1*a*. As the rubbing roller 27, for example, a metallic shaft around which a foam layer of EPDM rubber having an ASKER C hardness of 55° is formed as a roller body can be recited. The material of the roller body is not limited to EPDM rubber, and may be rubber or foam rubber of other material, and those having an ASKER C hardness of more than or equal to 10° and less than or equal to 90° are preferably used.

On the photosensitive drum 1*a* surface, on the downstream side from the abutment surface with the rubbing roller 27 in the rotation direction, the cleaning blade 28 is fixed in abutment with the photosensitive drum 1*a*. As the cleaning blade 28, for example, a blade of polyurethane rubber having a JIS hardness of 78° is used, and it is attached at a predetermined angle with respect to the tangent direction of the photosensitive drum at the abutment point. The material, hardness, dimension, amount of cutting into the photosensitive drum 1*a*, and pressure contact force and the like of the cleaning blade 28 are appropriately set depending on the specification of the photosensitive drum 1*a*.

The residual toner removed from the photosensitive drum 1*a* surface by the rubbing roller 27 and the cleaning blade 28 is discharged outside the cleaning device 5*a* in association with rotation of the recovery screw 29, and conveyed to a toner recovery container (not shown) and retained therein. As the toner to be used in the present disclosure, toner particles carrying, in their surfaces, a polishing agent such as silica, titanium oxide, strontium titanate or alumina embedded to partly project on the surface, and toner carrying a polishing agent electrostatically adhered to the surface are recited.

As shown in FIG. 3, the intermediate transfer unit 30 has the intermediate transfer belt 8 stretched between a drive roller 10 on the downstream side and a tension roller 11 on the upstream side, and primary transfer rollers 6*a* to 6*d* that are in contact with the photosensitive drums 1*a* to 1*d* with the intermediate transfer belt 8 interposed therebetween. At the position facing to the tension roller 11, the belt cleaning unit 19 for removing toner remaining on the intermediate transfer belt 8 surface is disposed. The detailed configuration of the belt cleaning unit 19 will be described later.

Next, a procedure for image formation in the image forming apparatus 100 will be described. Upon input of image formation start by a user, first the surfaces of the photosensitive drums 1*a* to 1*d* are charged uniformly by the chargers 2*a* to 2*d*. Then the surfaces of the photosensitive drums 1*a* to 1*d* are irradiated with light by the exposure unit 4 to form electrostatic latent images corresponding to the image signal on the respective photosensitive drums 1*a* to 1*d*. The developing units 3*a* to 3*d* are respectively charged with a predetermined amount of toner of respective colors, i.e., cyan, magenta, yellow and black by a supply device (not shown). The toner is supplied on the photosensitive drums 1*a* to 1*d* by the developing units 3*a* to 3*d* and electrostatically adhered thereto, and thus toner images corresponding to the electrostatic latent images formed by light exposure by the exposure unit 4 are formed.

Electric fields are applied at a predetermined transfer voltage between the primary transfer rollers 6*a* to 6*d* and the photosensitive drums 1*a* to 1*d* by the primary transfer rollers 6*a* to 6*d*, and the toner images of cyan, magenta, yellow and black on the photosensitive drums 1*a* to 1*d* are primarily transferred onto the intermediate transfer belt 8. These four color images are formed in predetermined positional relationships that are defined in advance for predetermined full color image formation. Then, the toner remaining on the surfaces of the photosensitive drums 1*a* to 1*d* is removed by the cleaning devices 5*a* to 5*d* and is ready for the subsequent new electrostatic latent image formation.

As the intermediate transfer belt 8 starts rotating clockwise in association with rotation of the drive roller 10 by the drive motor (not shown), the transfer paper sheet P is conveyed at a predetermined timing from the registration roller pair 12*b* to the secondary transfer roller 9 that is disposed adjacently to the intermediate transfer belt 8, and a full color image is transferred. The transfer paper sheet P on which the toner image is transferred is conveyed to the fixing portion 7. The toner remaining on the intermediate transfer belt 8 surface is removed by the belt cleaning unit 19.

The transfer paper sheet P conveyed to the fixing portion 7 is heated and pressed by a fixing roller pair 13 so that the toner image is fixed on the face of the transfer paper sheet P and thus a predetermined full color image is formed. The conveyance direction of the transfer paper sheet P on which the full color image is formed is switched by a branching portion 14 that branches into a plurality of directions. In forming an image on only one face of the transfer paper sheet P, the transfer paper sheet P is directly discharged to a discharge tray 17 by a discharge roller 15.

On the other hand, in forming images on both faces of the transfer paper sheet P, part of the transfer paper sheet P having passed the fixing portion 7 is temporarily made to project outside the apparatus from the discharge roller 15. Then the transfer paper sheet P is directed to the sheet conveyance path 18 at the branching portion 14 by reverse rotation of the discharge roller 15, and conveyed again to the secondary transfer roller 9 in the condition that the image face is reversed. Then, the next image formed on the intermediate transfer belt 8 is transferred by the secondary transfer roller 9 to the face of the transfer paper sheet P where no image is formed, and the transfer paper sheet P is conveyed to the fixing portion 7 where the toner image is fixed, and then discharged to the discharge tray 17.

Figure 4:
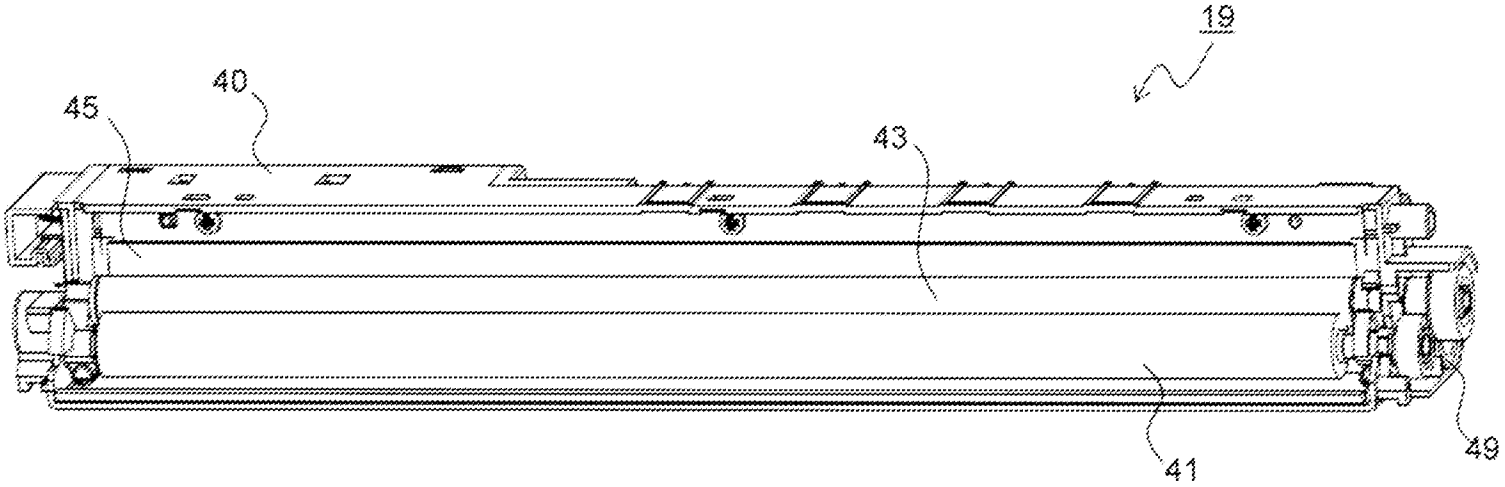
FIG. 4 is a perspective view of the appearance of a belt cleaning unit shown in FIG. 3.
Figure 5:
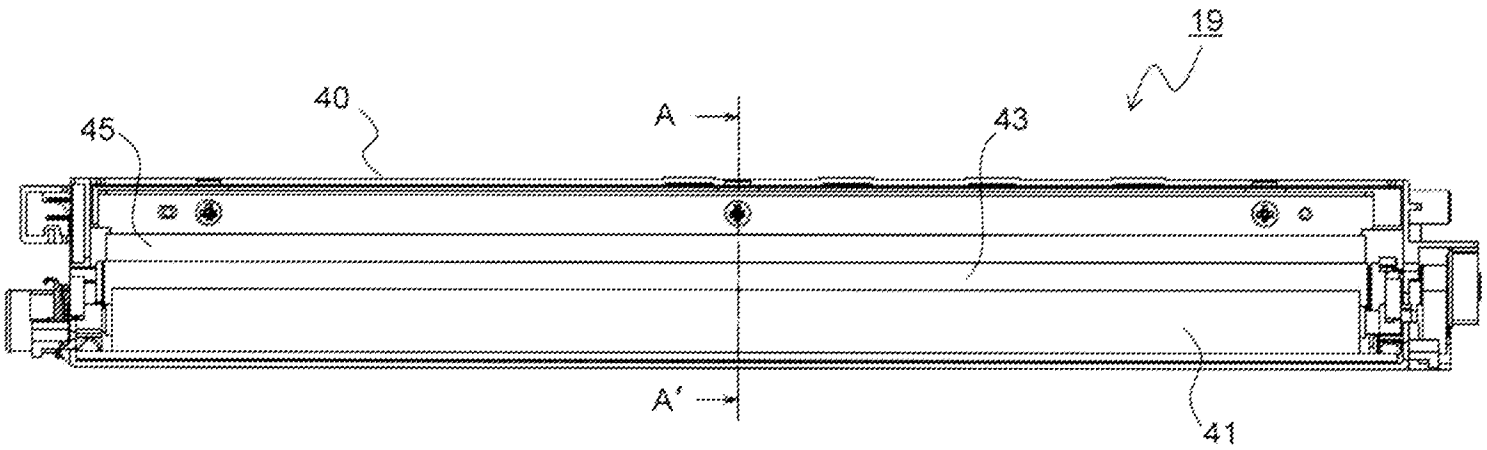
FIG. 5 is a front view of the belt cleaning unit shown in FIG. 3 seen from the intermediate transfer belt side.
Figure 6:
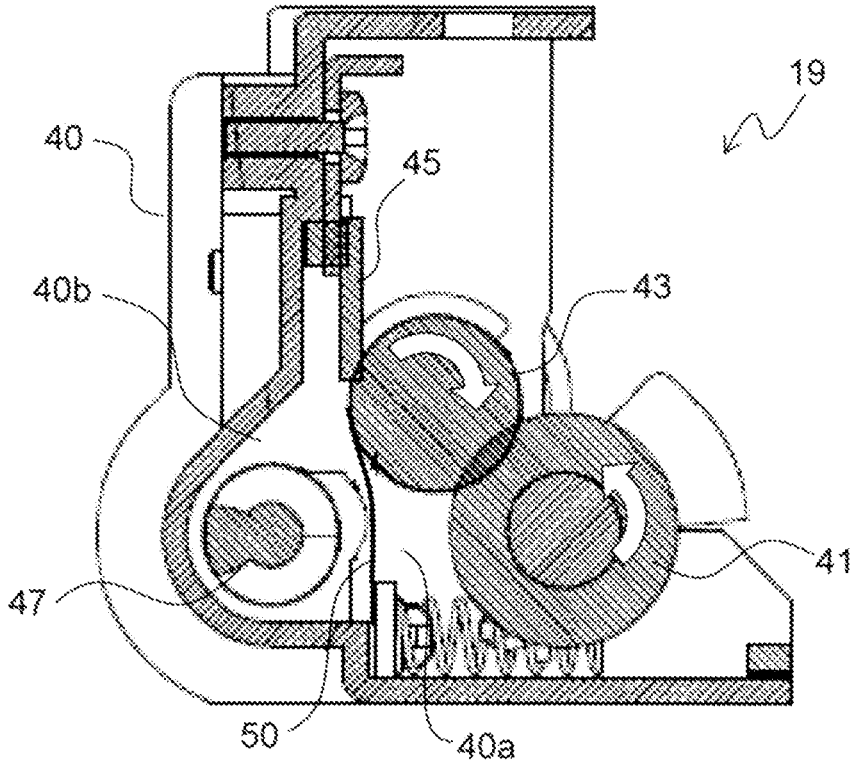
FIG. 6 is a lateral section view showing an internal configuration of the belt cleaning unit shown in FIG. 3.

FIG. 4 is a perspective view of the appearance of the belt cleaning unit 19 shown in FIG. 3, FIG. 5 is a front view of the belt cleaning unit 19 seen from the intermediate transfer belt 8 side (right hand in FIG. 3), and FIG. 6 is a lateral section view showing an internal configuration of the belt cleaning unit 19 (section view seen in the direction of arrows AA' in FIG. 5).

The belt cleaning unit 19 has a fur brush 41, a recovery roller 43, a scraper 45, and a conveyance spiral 47 in the housing 40. On one end of the housing 40, a train of drive input gears 49 for inputting a drive force to the fur brush 41, the recovery roller 43, and the conveyance spiral 47 is disposed. The fur brush 41 is disposed facing to the tension roller 11 with the intermediate transfer belt 8 interposed therebetween on the opening 40*a* side of the housing 40. The fur brush 41 scrapes off the foreign matters such as toner or paper powder (hereinafter, referred to as toner and the like) remaining on the intermediate transfer belt 8 by rotating in the counter direction to the moving direction of the intermediate transfer belt 8 (counterclockwise direction in FIG. 6). The scraped toner and the like adhere to a brush part of the fur brush 41.

The recovery roller 43 recovers toner and the like adhering to the fur brush 41 by rotating in the reverse direction to the fur brush 41 (clockwise direction in FIG. 6) while being in contact with the surface of the fur brush 41. The scraper 45 comes into contact with the recovery roller 43 from the downstream side (counter direction to the moving direction of the surface of the recovery roller 43) with respect to the rotation direction of the recovery roller 43, and scrapes off the toner and the like recovered by the recovery roller 43, thereby cleaning the recovery roller 43. The conveyance spiral 47 is disposed in a waste toner retaining portion 40*b* of the housing 40, and conveys the toner and the like scraped from the recovery roller 43 by the scraper 45 outside the housing 40.

As shown in FIG. 6, in the housing 40, a toner receiving seal 50 is disposed facing to the entire area in the longitudinal direction of the recovery roller 43. The toner receiving seal 50 is a sheet-like member formed, for example, of polyurethane or polyethylene terephthalate (PET), and is in contact with the recovery roller 43 at a predetermined contact pressure. The contact pressure of the toner receiving seal 50 needs to be set so that the toner adhering to the recovery roller 43 will not be scraped off, but the toner scraped by the scraper 45 will not travel again toward the recovery roller 43.

By the way, even if the contact surface of the end seal with respect to the toner receiving seal is limited as is in the aforementioned related art, the pressing force for the toner receiving seal is still high in the part where the end seal contacts. Accordingly, the contact pressure of the toner receiving seal with respect to the recovery roller is uneven in the longitudinal direction, and the toner on the recovery roller could be scraped off. Further, since the contact surface of the end seal with respect to the toner receiving seal is reduced, toner leakage could occur between the toner receiving seal and the end seal. In the above description, the cleaning device having a recovery roller for recovering toner from a cleaning member, and a toner receiving seal that contacts the recovery roller is exemplified. A similar problem exists also in a cleaning device having a cleaning roller for removing residual toner from an image carrier, and a toner receiving seal that contacts the cleaning roller. In contrast, according to the image forming apparatus 100, it is possible to effectively prevent both leakage of toner at the end portion of the toner receiving seal 50 and leakage of toner scraped off by the toner receiving seal 50 through the opening 40*a*.

Figure 7:
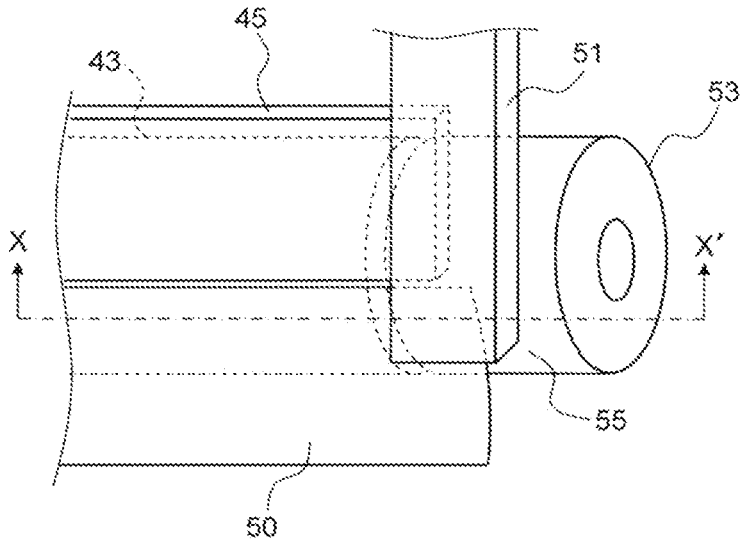
FIG. 7 is a partial perspective view of a bearing portion and its vicinity of a recovery roller in the image forming apparatus shown in FIG. 1, seen from the left hand in FIG. 6.
Figure 8:
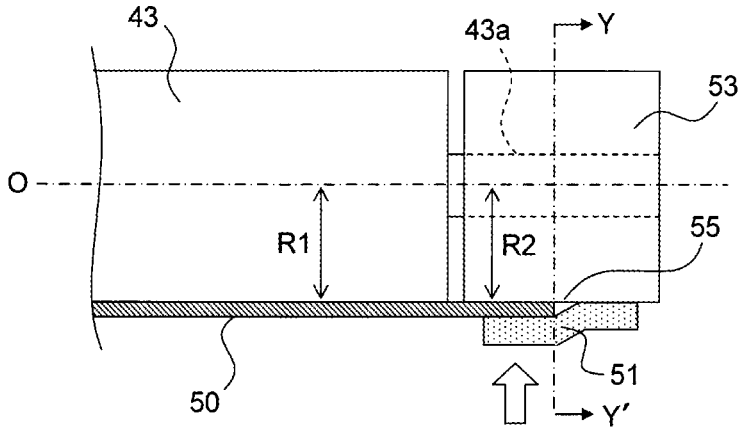
FIG. 8 is a planar section view of the bearing portion and its vicinity of the recovery roller in the image forming apparatus shown in FIG. 1.
Figure 9:
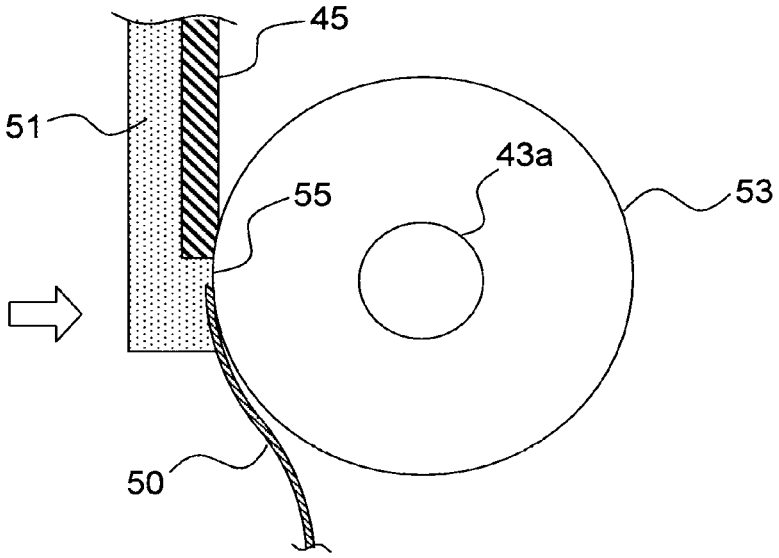
FIG. 9 is a lateral section view of the bearing portion and its vicinity of the recovery roller in the image forming apparatus shown in FIG. 1.

FIG. 7 is a partial perspective view of a bearing portion 53 and its vicinity of the recovery roller 43 seen from the left hand in FIG. 6. FIG. 8 is a planar section view (section view seen in the direction of arrows XX' in FIG. 7) of the bearing portion 53 and its vicinity of the recovery roller 43. FIG. 9 is a lateral section view of the bearing portion 53 and its vicinity of the recovery roller 43 (section view seen in the direction of arrows YY' in FIG. 8). For convenience of explanation, the housing 40 is not shown here. In FIG. 7 to FIG. 9, the configuration of the bearing portion 53 and its vicinity of one end of the recovery roller 43 (front side of paper face of FIG. 6) is shown, and the same applies to the configuration of the bearing portion 53 and its vicinity of the other end (back side of paper face in FIG. 6).

In the neighborhood of the bearing portion 53 in the housing 40, an end seal 51 is attached. The end seal 51 is formed of an elastic material such as foamed urethane, and prevents toner from leaking from the gap between the housing 40 and the bearing portion 53.

The bearing portion 53 that rotatably bears the recovery roller 43 is formed with a contact portion 55 having a radius R2 from a rotation axis O to the outer periphery that is equal to a radius R1 of the recovery roller 43. The longitudinal dimension of the toner receiving seal 50 is longer than the longitudinal dimension of the recovery roller 43, and the toner receiving seal 50 is disposed so that its end portion overlaps the contact portion 55. The end seal 51 is in contact with the contact portion 55 with the toner receiving seal 50 interposed therebetween, but is not in contact with the recovery roller 43.

By arranging in this manner, the force at which the end seal 51 presses the toner receiving seal 50 (shown by the white arrow in FIG. 8 and FIG. 9) acts only on the contact portion 55 (bearing portion 53), but not on the recovery roller 43. As a result, even if the contact pressure of the end seal 51 against the bearing portion 53 is increased, the contact pressure of the toner receiving seal 50 against the recovery roller 43 is kept substantially constant over the entire area in the width direction of the recovery roller 43. Therefore, the toner receiving seal 50 will not contact the recovery roller 43 at a contact pressure higher than needed, so that it is possible to prevent the toner adhering to the recovery roller 43 from being scraped off in the end portion of the toner receiving seal 50, and it is possible to prevent the scraped toner from leaking through the opening 40*a* (see FIG. 6).

Additionally, since it is possible to bring the toner receiving seal 50 and the end seal 51 into close contact with each other by increasing the contact pressure of the end seal 51 against the bearing portion 53, toner leakage from the gap between the toner receiving seal 50 and the end seal 51 can be securely prevented.

Curling of the scraper 45 is more likely to occur by exertion of a force on the end portion of the scraper 45. In the present embodiment, as shown in FIG. 7, the longitudinal dimension of the scraper 45 is made longer than the longitudinal dimension of the recovery roller 43, and the end portion of the scraper 45 is located at the contact portion 55. As a result, the end portion of the scraper 45 no longer receives a force by rotation of the recovery roller 43, so that it is possible to prevent the scraper 45 from curling.

In the present embodiment, the radius R1 of the recovery roller 43 and the radius R2 of the bearing portion 53 are set to be identical over the whole periphery, however, it suffices that at least the contact portion 55 where the scraper 45, the toner receiving seal 50, and the end seal 51 contact has the same diameter as the recovery roller 43.

The present disclosure is not limited to the above embodiment, and may be variously modified without departing from the scope of the present disclosure. For example, in the belt cleaning unit 19 of the above embodiment, the cleaning member has the fur brush 41 and the recovery roller 43, however, the present disclosure can be similarly applied in such a configuration that only a cleaning roller is used as the cleaning member, and a scraper for scraping toner from the surface of the cleaning roller is provided.

In the above embodiment, description was given for the exemplary case where the present disclosure is applied to the belt cleaning unit 19 for removing residual toner on the intermediate transfer belt 8 surface, and it goes without saying that the present disclosure can be similarly applied to the cleaning devices 5*a* to 5*d* for removing residual toner on the surfaces of the photosensitive drums 1*a* to 1*d*.

The present disclosure can be applied to various image forming apparatuses using a cleaning device such as a monochromatic copying machine, a digital multifunction peripheral, a facsimile machine and a laser printer, as well as the tandem type color image forming apparatus as shown in FIG. 1.

The present disclosure is applicable to a cleaning device having a mechanism of preventing residual toner on the surface of an image carrier using a cleaning member. By application of the present disclosure, it is possible to provide a cleaning device capable of effectively preventing both leakage of toner at an end portion of a toner receiving seal disposed facing to the entire area in the longitudinal direction of a roller-shaped cleaning member, and leakage of scraped toner in the toner receiving seal through an opening, and an intermediate transfer unit and an image forming apparatus having the same.

It is to be understood that the embodiments herein are illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. A cleaning device comprising:

a housing formed with an opening facing to an image carrier, and a waste toner retaining portion for retaining toner scraped from a surface of the image carrier;

a roller-shaped cleaning member disposed near the opening of the housing, for removing residual toner on the surface of the image carrier;

a pair of bearing portions that rotatably bear both ends of a rotation axis of the cleaning member;

a toner receiving seal, disposed facing to an entire area in a longitudinal direction of the cleaning member, configured to prevent reverse flow of waste toner toward the opening from the waste toner retaining portion; and an end seal formed of an elastic material, disposed in a gap between the housing and each of the bearing portions, configured to prevent leakage of waste toner from both end portions of the housing, wherein the cleaning member includes a cleaning roller for scraping off residual toner on the surface of the image carrier, and a recovery roller for recovering waste toner adhered to a surface of the cleaning roller, the toner receiving seal is longer than the recovery roller in the longitudinal direction of the recovery roller, is disposed facing to the entire area in the longitudinal direction of the recovery roller, and a surface thereof facing the recovery roller extends to be laid across each end portion of the cleaning member and outer periphery of the bearing portion, the bearing portion has a contact portion where the toner receiving seal contacts, and the contact portion has a same outer diameter as, the cleaning member, a scraper configured to scrape off waste toner on a surface of the recovery roller is disposed to be in contact with the entire area in the longitudinal direction of the recovery roller from a counter direction to a rotation direction of the recovery roller, a longitudinal dimension of the scraper is longer than a longitudinal dimension of the recovery roller, and both end portions of the scraper are disposed between the bearing portion and the end seal, and the end seal is disposed facing to the contact portion with the toner receiving seal interposed therebetween.

2. The cleaning device according to claim 1, wherein the image carrier is an intermediate transfer belt, and the cleaning roller is a fur brush for scraping off residual toner on a surface of the intermediate transfer belt.

3. An intermediate transfer unit comprising a cleaning device, and an intermediate transfer belt from which residual toner is to be removed by the cleaning device, wherein the cleaning device includes:

a housing formed with an opening facing the intermediate transfer belt, and a waste toner retaining portion for retaining toner scraped from a surface of the intermediate transfer belt;

a roller-shaped cleaning member disposed near the opening of the housing, for removing residual toner on the surface of the intermediate transfer belt;

a pair of bearing portions that rotatably bear both ends of a rotation axis of the cleaning member;

a toner receiving seal disposed facing to an entire area in a longitudinal direction of the cleaning member, configured to prevent reverse flow of waste toner toward the opening from the waste toner retaining portion; and an end seal formed of an elastic material, disposed in a gap between the housing and each of the bearing portions, configured to prevent leakage of waste toner from both end portions of the housing, the cleaning member includes a fur brush for scraping off residual toner on the surface of the intermediate transfer belt, and a recovery roller for recovering waste toner adhering to a surface of the fur brush, the toner receiving seal is longer than the recovery roller in the longitudinal direction of the recovery roller, is disposed facing to the entire area in the longitudinal direction of the recovery roller, and a surface thereof facing the recovery roller extends to be laid across each end portion of the cleaning member and outer periphery of the bearing portion, the bearing portion has a contact portion where the toner receiving seal contacts, and the contact portion has a same outer diameter as the cleaning member, a scraper configured to scrape off waste toner on a surface of the recovery roller is disposed to be in contact with the entire area in the longitudinal direction of the recovery roller from a counter direction to a rotation direction of the recovery roller, a longitudinal dimension of the scraper is longer than a longitudinal dimension of the recovery roller, and both end portions of the scraper are disposed between the bearing portion and the end seal, and the end seal is disposed facing to the contact portion with the toner receiving seal interposed therebetween.

4. An image forming apparatus comprising a cleaning device, wherein the cleaning device includes:

a housing formed with an opening facing an image carrier, and a waste toner retaining portion for retaining toner scraped from a surface of the image carrier;

a roller-shaped cleaning member disposed near the opening of the housing, for removing residual toner on the surface of the image carrier;

a pair of bearing portions that rotatably bear both ends of a rotation axis of the cleaning member;

a toner receiving seal disposed facing to an entire area in a longitudinal direction of the cleaning member, configured to prevent reverse flow of waste toner toward the opening from the waste toner retaining portion; and an end seal formed of an elastic material, disposed in a gap between the housing and each of the bearing portions, configured to prevent leakage of waste toner from both end portions of the housing, the cleaning member includes a cleaning roller for scraping off residual toner on the surface of the image carrier, and a recovery roller for recovering waste toner adhered to a surface of the cleaning roller, the toner receiving seal is longer than the recovery roller in the longitudinal direction of the recovery roller, is disposed facing to the entire area in the longitudinal direction of the recovery roller, and a surface thereof facing the recovery roller extends to be laid across each end portion of the cleaning member and outer periphery of the bearing portion, the bearing portion has a contact portion where the toner receiving seal contacts, and the contact portion has a same outer diameter as the cleaning member, a scraper configured to scrape off waste toner on a surface of the recovery roller is disposed to be in contact with the entire area in the longitudinal direction of the recovery roller from a counter direction to a rotation direction of the recovery roller, a longitudinal dimension of the scraper is longer than a longitudinal dimension of the recovery roller, and both end portions of the scraper are disposed between the bearing portion and the end seal, and the end seal is disposed facing to the contact portion with the toner receiving seal interposed therebetween.

* * * * *